US008611556B2

(12) United States Patent
Makinen et al.

(10) Patent No.: US 8,611,556 B2
(45) Date of Patent: Dec. 17, 2013

(54) CALIBRATING MULTIPLE MICROPHONES

(75) Inventors: Kalle Makinen, Tampere (FI); Matti Kajala, Tampere (FI)

(73) Assignee: Nokia Corporation, Espoo (FI)

( * ) Notice: Subject to any disclaimer, the term of this patent is extended or adjusted under 35 U.S.C. 154(b) by 641 days.

(21) Appl. No.: 12/989,574

(22) PCT Filed: Apr. 22, 2009

(86) PCT No.: PCT/FL2009/050314

§ 371 (c)(1),
(2), (4) Date: Nov. 9, 2010

(87) PCT Pub. No.: WO2009/130388

PCT Pub. Date: Oct. 29, 2009

(65) Prior Publication Data

US 2011/0051953 A1 Mar. 3, 2011

Related U.S. Application Data

(60) Provisional application No. 61/125,475, filed on Apr. 25, 2008.

(51) Int. Cl.
*H04R 3/00* (2006.01)

(52) U.S. Cl.
USPC ..... 381/92; 381/94.2; 381/94.3; 367/13

(58) Field of Classification Search
USPC ..... 381/92, 94.2, 94.3, 26, 111, 95, 56, 381/122; 700/94; 703/4; 367/119, 124, 125, 367/127, 129, 13
See application file for complete search history.

(56) References Cited

U.S. PATENT DOCUMENTS

| | | | |
|---|---|---|---|
| 5,123,887 | A | 6/1992 | Shimura |
| 5,242,364 | A | 9/1993 | Lehmann |
| 5,276,765 | A | 1/1994 | Freeman et al. |
| 5,383,392 | A | 1/1995 | Kowalewski et al. |
| 5,459,814 | A | 10/1995 | Gupta et al. |
| 5,657,422 | A | 8/1997 | Janiszewski et al. |
| 5,687,241 | A | 11/1997 | Ludvigsen |
| 5,749,067 | A | 5/1998 | Barrett |
| 5,793,642 | A | 8/1998 | Frisch et al. |
| 5,822,718 | A | 10/1998 | Bakis et al. |

(Continued)

FOREIGN PATENT DOCUMENTS

| | | |
|---|---|---|
| EP | 0335521 | 10/1989 |
| EP | 0734012 A2 | 9/1996 |

(Continued)

OTHER PUBLICATIONS

Hoffman, Michael W., et al., "GSC-Based Spatial Voice Activity Detection for Enhanced Speech Coding in the Presence of Competing Speech", IEEE Transactions on Speech and Audio Processing, vol. 9, No. 2, Mar. 2001, pp. 175-179.

(Continued)

*Primary Examiner* — Vivian Chin
*Assistant Examiner* — Friedrich W Fahnert
(74) *Attorney, Agent, or Firm* — Nokia Corporation

(57) ABSTRACT

The specification and drawings present a new method, apparatus and software product for calibrating multiple microphones (e.g., a microphone array) to match their sensitivity using an ambient noise by creating and updating one or more calibration signal level difference histograms.

20 Claims, 5 Drawing Sheets

(56) References Cited

U.S. PATENT DOCUMENTS

| | | | | |
|---|---|---|---|---|
| 5,963,901 | A | 10/1999 | Vahatalo et al. | |
| 6,023,674 | A | 2/2000 | Mekuria | |
| 6,182,035 | B1 | 1/2001 | Mekuria | |
| 6,427,134 | B1 | 7/2002 | Garner et al. | |
| 6,449,593 | B1 | 9/2002 | Valve | |
| 6,556,967 | B1 | 4/2003 | Nelson et al. | |
| 6,574,592 | B1 | 6/2003 | Nankawa et al. | |
| 6,647,365 | B1 | 11/2003 | Faller | |
| 6,675,125 | B2 | 1/2004 | Bizjak | |
| 6,810,273 | B1 | 10/2004 | Mattila et al. | |
| 7,174,022 | B1 | 2/2007 | Zhang et al. | |
| 7,203,323 | B2 | 4/2007 | Tashev | |
| 2001/0056291 | A1 | 12/2001 | Zilberman et al. | |
| 2002/0103636 | A1 | 8/2002 | Tucker et al. | |
| 2002/0138254 | A1 | 9/2002 | Isaka et al. | |
| 2002/0193130 | A1 | 12/2002 | Yang et al. | |
| 2003/0228023 | A1 | 12/2003 | Burnett et al. | |
| 2004/0042626 | A1 | 3/2004 | Balan et al. | |
| 2004/0117176 | A1 | 6/2004 | Kandhadai et al. | |
| 2004/0122667 | A1 | 6/2004 | Lee et al. | |
| 2005/0108004 | A1 | 5/2005 | Otani et al. | |
| 2005/0147258 | A1 | 7/2005 | Myllyla et al. | |
| 2006/0053007 | A1 | 3/2006 | Niemisto | |
| 2007/0136053 | A1 | 6/2007 | Ebenezer | |
| 2008/0091421 | A1 | 4/2008 | Gustavsson | |
| 2008/0175407 | A1* | 7/2008 | Zhang et al. | 381/92 |
| 2008/0199024 | A1 | 8/2008 | Nakadai et al. | |
| 2008/0260175 | A1* | 10/2008 | Elko | 381/73.1 |
| 2008/0317259 | A1 | 12/2008 | Zhang et al. | |
| 2009/0089053 | A1 | 4/2009 | Wang et al. | |
| 2011/0103626 | A1 | 5/2011 | Bisgaard et al. | |

FOREIGN PATENT DOCUMENTS

| | | | |
|---|---|---|---|
| EP | 1453349 | A2 | 9/2004 |
| WO | 01/37265 | A1 | 5/2001 |
| WO | 2007013525 | | 2/2007 |
| WO | 2007/138503 | A1 | 12/2007 |

OTHER PUBLICATIONS

Widrow, Bernard, "Adaptive Noise Cancelling: Principles and Applications", Proceedings of the IEEE, vol. 63, No. 12, Dec. 1975, pp. 1692-1716.

Gazor, et al., "A soft voice activity detector based on a Laplacian-Gaussian model", IEEE Transaction Speech and Audio Processing, vol. 11, No. 5, Sep. 2003, 498-505 pages.

Marzinzik, et al., "Speech pause detection for noise spectrum estimation by tracking power envelope dynamics", IEEE Transaction Speech and Audio Processing, vol. 10, No. 2, Feb. 2002, 109-118 pages.

Teutsch, et al. "An Adaptive Close-Talking Microphone Array", New Paltz, New York, Oct. 21-24, 2001, 4 Pages.

Buck, et al., "Self-calibrating microphone arrays for speech signal acquisition: a systematic approach", vol. 86 , Issue 6, Jun. 2006, 1230-1238 pages.

Hansler, et al., Acoustic echo and noise control: A Practical Approach, John Wiley & Sons, Inc. Hoboken, New Jersey, 2004.

International Search Report and Written Opinion received in corresponding PCT Application No. PCT/IB2009/005374, dated, Aug. 12, 2009, 14 pages.

Office Action received in related U.S. Appl. No. 12/109,861, dated May 5, 2011, 7 pages.

International Search Report and Written Opinion received in corresponding PCT Application No. PCT/FI2009/050314 dated Sep. 3, 2009, 10 pages.

File history for related (abandoned) U.S. Appl. No. 11/214,454, filed Aug. 29, 2005, 200 pages.

Zhibo Cai, et al., "A knowledge based real-time speech detector for microphone array video conferencing system" Signal Processing, 2002 6th International Conference on Aug. 26-30, 2002, Piscataway, New Jersey, USA, IEEE, vol. 1, pp. 350-353.

Furui, et al., Advances in Speech signal processing, Newyork: Marcel Dekker, 1992.

Gray, Jr., et al, "A spectral-flatness measure for studying the auto correlation method of linear prediction of speech analysis", IEEE Transaction Acoustics, Speech, Signal Processing, vol. ASSP-22, Jun. 1974, 207-216 pages.

Prasad et al., "Comparison of Voice Activity Detection Algorithms for VoIP", Proceedings of the 7th International Symposium on Computers and Communications, dated Jul. 1-4, 2002, pp. 530-535.

International Search Report and Written Opinion received in corresponding PCT Application No. PCT/FI2009/050302 dated Nov. 21, 2005, 11 pages.

"Mandatory Speech Codec speech processing functions AMR speech codec" Voice Activity Detector (VAD), Technical Specification Group Services and System Aspects; 3rd Generation Partnership Project; 3G TS 26.094 version 3.0.0, date Oct. 1999, 29 Pages.

Extended European Search Report received for corresponding European Patent Application No. 05775189.3, dated Nov. 3, 2008, 7 Pages.

Office Action received for corresponding U.S. Appl. No. 13/584,243, dated Jan. 9, 2013, 13 pages.

Office Action received for related U.S. Appl. No. 13/584,243, dated Jun. 27, 2013, 9 pages.

* cited by examiner

CALIBRATING MULTIPLE MICROPHONES

RELATED APPLICATION

This application was originally filed as PCT Application No. PCT/FI2009/050314 filed Apr. 22, 2009, which claims priority benefit from U. S. Provisional application Ser. No. 61/125,475, filed Apr. 25, 2008.

TECHNICAL FIELD

This invention generally relates to audio signal processing, and more specifically to calibrating more than one microphone (e.g., a microphone array) using a signal level difference histogram algorithm.

BACKGROUND ART

There are many applications that utilize two or more microphones (e.g., microphone arrays) to pick up an acoustic signal. Separate microphone signals can be processed to obtain enhanced signals. One of the enhancement applications is acoustic beamforming, which means that sounds coming from different directions are attenuated differently. For example, if a person is speaking on the phone in a noisy environment, the acoustic beam can be directed towards the speaker, which will provide an improved signal-to-noise ratio of the picked signal, because the background noise is attenuated while the speech is preserved. For implementing acoustic beamforming successfully, matching microphone sensitivity is an important factor.

Majority, if not all, of the applications utilizing several microphones, benefit from matching the sensitivities of the microphones. If the frequency responses of the microphones are similar enough, only a full-band gain has to be applied into N−1 of the microphone signals if N is the number of microphones.

A conventional microphone capsule sensitivity tolerance is within a few decibels. This means that two random microphone capsules of the same type may have several decibels sensitivity difference. It is assumed that a sensitivity difference of a few decibels would be quite common in a product utilizing two or more microphones. On the other hand, the acoustic beamformer requires that the microphone sensitivities are matched more accurately; otherwise the beamformer may significantly deteriorate the desired signal.

A conventional way to match the microphone sensitivities is to use a manual calibration. This means that the individual microphone components are first measured using a suitable calibration measurement. After the measurement, matching microphone components are selected to be used in the array. Alternatively, the sensitivity differences found in the measurement can be compensated by building up a matched array. The compensation can be carried out either utilizing microphone specific full-band gains or, in case of non-similar frequency responses, microphone specific filters that match both the frequency responses and sensitivities of the microphones of the array. The manual method is obviously very expensive to be utilized in mass-production. Besides, possible later sensitivity mismatch due to the aging of the microphone components requires a new calibration.

Another group of calibration methods utilizes a dedicated signal source for calibrating the microphone array in place. This makes the re-calibration easier to carry out. The method usually requires an accurate knowledge about the placement of the microphones relative to the sound source. Also the calibration environment has to be controlled.

Yet another group of calibration methods is automatic self-calibration methods. These methods exploit the signals picked up by the microphones during normal operation of the array. For the calibration, typical implementations use either the whole signal or time intervals of the signal when the desired signal is active. When dealing with close-talking microphone arrays, the whole signal is not usable for the calibration purposes, since the sound pressure level of the desired signal is different at different microphones whereas the level of usual ambient noise is more or less the same at different microphones. Therefore, a separation between desired signal and ambient noise is required. If the desired signal is utilized for self-calibration, the microphone positions and the direction of arriving sound have to be known or estimated. Any estimation faults of these factors can cause errors in the calibration.

DISCLOSURE OF THE INVENTION

According to a first aspect of the invention, apparatus, comprises: a signal processing module, configured to calculate one or more differences between one or more signal levels from one or more microphones of a plurality of microphones and further one or more signal levels from one or more selected microphones of the plurality of the microphones, configured to create or update one or more difference histograms corresponding to the one or more of selected microphones using the one or more differences, and further configured to determine a sharpness and a sensitivity difference for each of the one or more difference histograms; and a gain control module, configured to adjust one or more amplifying gains for one or more microphone signals corresponding to the one or more microphones using the sensitivity difference for each of the one or more difference histograms corresponding to one of the one or more microphones, if the sharpness meets a predetermined criterion, for matching sensitivities of the plurality of microphones.

According further to the first aspect of the invention, the signal processing module may be configured to update one of the difference histograms corresponding to one of the one or more of the selected microphones if a corresponding difference for the one of the one or more of the selected microphones is within a predetermined range.

Further according to the first aspect of the invention, the signal processing module may be configured to determine the sharpness of the each of the difference histograms only if the each of the one or more difference histograms is matured.

Still further according to the first aspect of the invention, if the sharpness meets a predetermined criterion for one of the one or more microphones, the signal processing module may be configured to determine the sensitivity difference by identifying a maximum peak location on the each of the one or more difference histograms or using an interpolation. Still further, the signal processing module may be configured to provide the sensitivity difference to the gain control module to adjust the one or more amplifying gains. Yet still further, the signal processing module may be configured to update the sensitivity difference using one or more smoothing methods and to provide the sensitivity difference, after being updated using the one or more smoothing methods, to the gain control module to adjust the one or more amplifying gains.

According further to the first aspect of the invention, the apparatus may be a part of an electronic device comprising the plurality of the microphones.

According still further to the first aspect of the invention, the apparatus may further comprise: a low-pass filter or a plurality of low-pass filters configured to eliminate high frequency components from signals with the one or more signal levels and with the further one or more signal levels.

According further still to the first aspect of the invention, the apparatus may further comprise: a signal level calculator, configured to compute the one or more signal levels and the further one or more signal levels for providing to the signal processing module. Still further, the signal level calculator and the signal processing module may be combined.

Yet still further according to the first aspect of the invention, the apparatus may further comprise: a signal classification module, configured to separate a signal from each of the one or microphones into a speech and noise components, and further configured to provide one or more control signals comprising calibration-suitable information to the signal processing module.

Still yet further according to the first aspect of the invention, the apparatus may further comprise: an analog-to-digital converter, configured to convert analog microphone signals of the plurality of the microphones into digital microphone signals before determining the one or more signal levels and the further one or more signal levels.

Still further still according to the first aspect of the invention, the apparatus may further comprise: a memory, configured to store the one or more amplifying gains provided by the gain control module.

Further according to the first aspect of the invention, an integrated circuit may comprise selected or all modules of the apparatus.

Still further according to the first aspect of the invention, the apparatus may be configured to provide the sensitivity difference for the each of the one or more difference histograms and to adjust the one or more amplifying gains independently of locations of the plurality of the microphones.

According further to the first aspect of the invention, the plurality of the microphones may be an array of the microphones.

According still further to the first aspect of the invention, the one or more signal levels and the further one or more signal levels may be power signal levels calculated for a predetermined frame length.

According to a second aspect of the invention, a method, comprises: calculating one or more differences between one or more signal levels from one or more microphones of a plurality of microphones and further one or more signal levels from one or more selected microphones of the plurality of the microphones; creating or updating one or more difference histograms corresponding to the one or more of selected microphones using the one or more differences, and determining a sharpness and a sensitivity difference for each of the one or more difference histograms; and adjusting one or more amplifying gains for one or more microphone signals corresponding to the one or more microphones using the sensitivity difference for each of the one or more difference histograms corresponding to one of the one or more microphones, if the sharpness meets a predetermined criterion, for matching sensitivities of the plurality of microphones.

According further to the second aspect of the invention, the one or more signal levels and the further one or more signal levels may be power signal levels calculated for a predetermined frame length.

Further according to the second aspect of the invention, the updating of one of the difference histograms corresponding to one of the one or more of the selected microphones may be performed if a corresponding difference for the one of the one or more of the selected microphones is within a predetermined range.

Still further according to the second aspect of the invention, the determining the sharpness of the each of the difference histograms may be performed only if the each of the one or more difference histograms is matured.

According further to the second aspect of the invention, if the sharpness meets a predetermined criterion for one of the one or more microphones, the determining of the sensitivity difference may be performed by identifying a maximum peak location on the each of the one or more difference histograms or using an interpolation. Still further, the determining of the sensitivity difference may be performed by updating the sensitivity difference using one or more smoothing methods.

According still further to the second aspect of the invention, prior to the calculating the differences, the method may comprise: filtering high frequency components from signals with the one or more signal levels and with the further one or more signal levels.

According further still to the second aspect of the invention, prior to the calculating the differences, the method may comprise: computing the one or more signal level and the further one or more signal levels for providing to the gain control module.

According yet further still to the second aspect of the invention, prior to the calculating the differences, the method may comprise: separating a signal from each of the one or microphones into a speech and noise components, and providing one or more control signals comprising calibration-suitable information.

Yet still further according to the second aspect of the invention, the method may further comprise: storing said one or more amplifying gains.

Still yet further according to the second aspect of the invention, the plurality of the microphones may be an array of the microphones.

According to a third aspect of the invention, a computer program product comprises: a computer readable storage structure embodying a computer program code thereon for execution by a computer processor with the computer program code, wherein the computer program code comprises instructions for performing the method of the second aspect of the invention.

According to a fourth aspect of the invention, an electronic device, comprises: a plurality of microphones; and a multiple microphone calibration module, comprising: a signal processing module, configured to calculate one or more differences between one or more signal levels from one or more microphones of a plurality of microphones and further one or more signal levels from one or more selected microphones of the plurality of the microphones, configured to create or update one or more difference histograms corresponding to the one or more of selected microphones using the one or more differences, and further configured to determine a sharpness and a sensitivity difference for each of the one or more difference histograms; and a gain control module, configured to adjust one or more amplifying gains for one or more microphone signals corresponding to the one or more microphones using the sensitivity difference for each of the one or more difference histograms corresponding to one of the one or more microphones, if the sharpness meets a predetermined criterion, for matching sensitivities of the plurality of microphones.

According further to the fourth aspect of the invention, the multiple microphone calibration module may be detachable from the electronic device.

BRIEF DESCRIPTION OF THE DRAWINGS

For a better understanding of the nature and objects of the present invention, reference is made to the following detailed description taken in conjunction with the following drawings, in which:

FIG. 3*a* corresponds to a "sharp" trustworthy case and FIG. 3*b* corresponds to a "broad" non-trustworthy case;

MODES FOR CARRYING OUT THE INVENTION

Figure 1:
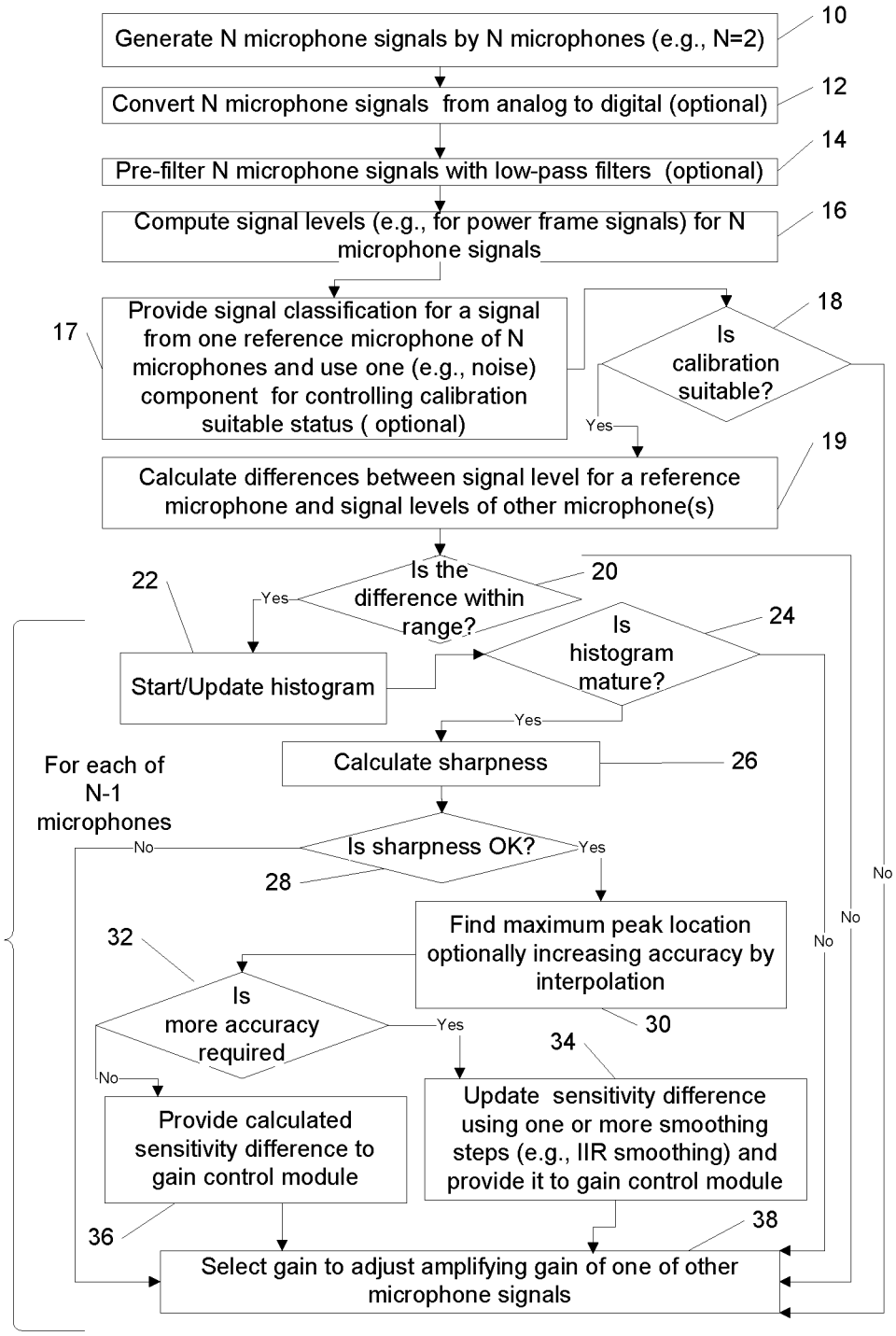
FIG. 1 is a flow chart illustrating multiple microphones (e.g., a microphone array) calibration algorithm, according to an embodiment of the present invention.

A new method, apparatus and software product are presented for calibrating multiple microphones (e.g., a microphone array) to match their sensitivity using an ambient noise by creating and updating one or more calibration signal level difference histograms. Using ambient noise for the sensitivity calibration can eliminate the requirement for knowing the microphone positions and a direction of arrival of the desired acoustic signal. According to one embodiment, a multiple microphone calibration module performing the sensitivity calibration may be build-in as a part of an electronic device comprising the multiple microphones or it may be a stand-alone unit, which can be attached to an electronic device (e.g., a mobile phone) for the sensitivity calibration.

According to embodiments of the present invention, the microphone sensitivity difference may be detected using a signal level (e.g., power level) difference histogram. In one simple scenario, according to one embodiment of the present invention, during the natural operation of the microphone array, the sampled microphone signals may be divided into frames whose power levels are calculated (though this division may not be used for applying the calibration procedure described herein). The frames then may be classified to be either a background noise or a desired signal, e.g., speech. If the frame is classified as the background noise, the difference of the power levels of the microphone signals can be stored into the histogram.

Then the microphone sensitivity difference can be derived from the area around the highest peak in the histogram. Using the signal (e.g., power) level difference histogram instead of direct smoothing of the level difference can provide information whether the found microphone sensitivity difference indicated by the histogram is trustworthy. After the histogram has obtained enough data, i.e., the derived distribution becomes mature enough (e.g., acquiring a predetermined amount of data in the histogram, or a threshold total value of all histogram bins), the shape of the distribution can indicate the reliability of the obtained microphone sensitivity difference: a sharp distribution may indicate a reliable estimate while a broad distribution suggests that the estimate cannot be trusted.

The sensitivity difference estimate can be derived from the peak location of the distribution on the histogram. Whenever the histogram is mature enough and the shape of it indicates that the estimate is reliable, a sensitivity difference value (or the sensitivity difference) may be used. The obtained sensitivity difference can be further smoothed, e.g., using a suitable IIR (infinite impulse response) filtering, to obtain a more stable estimate. Since this estimate may still be quite fluctuating, it is possible to apply a second smoothing to it, and so on. The number smoothings may be defined by the required accuracy of calibration. For example, the reason for using two separate smoothing stages may be that the faster one ($1^{st}$ smoothing) can offer a quicker estimate and the slower ($2^{nd}$) smothing can provide a more stable and more precise estimate that may be used in a long run (e.g., stored in a memory). All additional estimates (smoothings) may be also equipped with a maturity check, which can indicate if the estimate is ready to be used.

According to a further embodiment, after the microphone sensitivity difference has been detected for a signal from a particular microphone, a corresponding gain may be applied to a channel used for processing that signal. More detailed description of the algorithm is provided herein.

FIG. 1 shows an example of a flow chart illustrating multiple microphones (e.g., a microphone array) calibration algorithm, according to various embodiment of the present invention.

The flow chart of FIG. 1 only represents one or more possible scenarios among many others. In a method according to an embodiment of the present invention, in a first step 10, N microphone signals are generated by N microphones (e.g., N is at least a value of two). In a next step 12, N microphone signals may be converted from analog to digital domain: this step corresponds to a digital implementation of the calibration algorithm according to various embodiments of the present invention, but in principle this calibration algorithm may be used in the analog domain as well.

In a next step 14, N microphone signals may be pre-filtered using one or more low-pass filters (this is an optional step). The low-pass-filtering may be useful, since the microphones (including microphone capsules and surrounding acoustic constructions) are not as directive at low frequencies, and hence using this pre-filtering may lead to better results. For example, 1-kHz roll-off frequency can be used.

In a next step 16, signal levels (e.g., power frame signals) for N microphone signals can be computed. This step may be implemented by computing signal powers "frame-wisely" using a suitable frame length, e.g., 5 ms.

In a next step 17 a signal classification for a signal from one (or more) reference microphone of the N microphones may be implemented for controlling the calibration status. For example, if one component (e.g., noise) is identified, this will indicate that the calibration is suitable, whereas if another component (e.g., speech) is identified, this will indicate that calibration is not suitable. A simple voice activity detector (VAD) based on the power of one microphone signal may be used to distinguish between speech and noise frames. Then in a next step 18, it is ascertained whether the calibration is suitable as explained herein. If that is not the case (e.g., the frame is classified as speech), the process may go to step 38. However, if it is ascertained that the calibration is suitable (e.g., the frame is classified as noise), in a next step 19, differences between a signal level for a reference microphone and signal levels of other (selected) microphones (or just one microphone for N=2) may be calculated.

In a next step 20, it is ascertained whether the calculated difference is within a pre-defined range. If that is the case, in a next step 22, the difference may be stored into a histogram (starting or updating the histogram for the corresponding microphone). The acceptance range may be defined according to the sensitivity tolerance of the utilized microphone capsules. For example, with a tolerance of ±3 dB two microphones may have, at most, a sensitivity difference of ±6 dB, and thus the acceptance range can be ±6 dB. The histogram may be updated in such a manner that all bins of the histogram are multiplied with a positive factor less than one and after that the bin corresponding to the amount of difference is increased by adding a constant value to it. If however, it is ascertained in step 20 that the difference is not within the predetermined range, the process may go to step 38. It is noted that steps 22-38 may be performed for each of the non-referenced N−1 microphones separately to match their sensitivity to the selected referenced microphone.

In a next step 24, it is ascertained whether the histogram is mature, i.e., if the histogram has obtained enough data and is ready to be used. If that is not the case, the process may go to step 38. If however, it is ascertained that the histogram is mature, in a next step 26, the sharpness may be determined (calculated). The sharpness can be defined, e.g., by a ratio of the maximum bin height and the sum of all bin heights.

In a next step 28, it is ascertained whether the sharpness is "sharp enough": the calculated sharpness may be compared against a sharpness threshold and if it exceeds that threshold, the sharpness is sharp enough, otherwise the histogram is broad and is not ready for calibration purposes. The sensitivity difference may be derived if the histogram is sharp enough. This principle relies on the fact that the sensitivity of a microphone stays constant, since changes due to aging of the component or other environmental effects are very slow from the viewpoint of the operating speed of the histogram calibration process. Therefore, the true sensitivity difference of two microphones stays constant meaning that the distribution presented in the histogram can be concentrated around the true sensitivity difference. However, if the histogram becomes broad, this indicates that the signal has not been suitable for calibration purposes (e.g., in case of a wind noise).

Figure 3A:
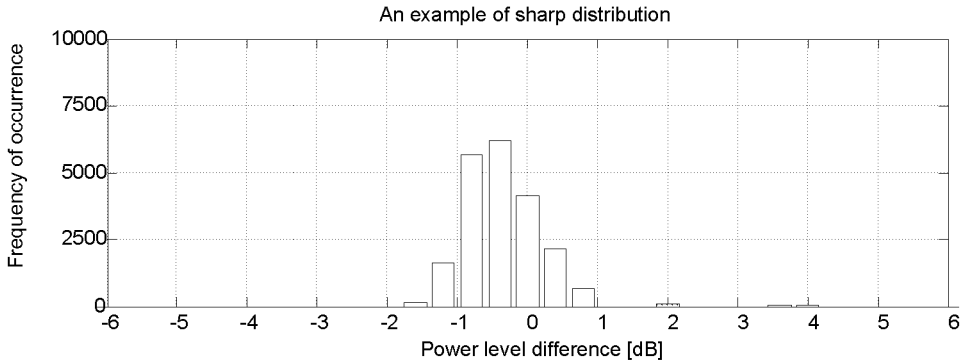
FIGS. 3*a* and 3*b* are histograms generated according to embodiments of the present invention for two microphones used in a mobile phone.
Figure 3B:
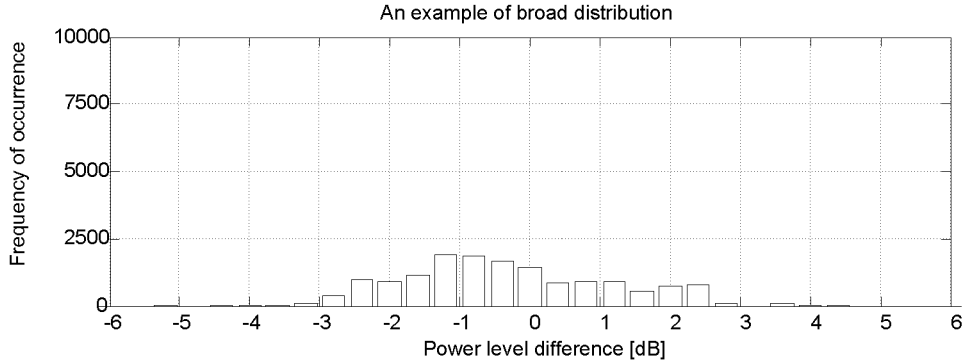

FIGS. 3*a* and 3*b* shows examples among others of sharp and broad power level difference distributions. Histograms shown in FIGS. 3*a* and 3*b* are generated according to embodiments of the present invention for two microphones in a mobile phone. FIG. 3*a* corresponds to a "sharp" trustworthy case and FIG. 3*b* corresponds to a "broad" non-trustworthy case with low sharpness. The histogram shown in FIG. 3*a* is generated from a recording carried out in a car noise environment and FIG. 3*b* presents a histogram from recording performed in a wind noise environment.

Thus, if it is ascertained in step 28 of FIG. 1, that the sharpness is below the sharpness threshold, then the process goes to step 38. If, however, it is ascertained that the sharpness is above the sharpness threshold, in a next step 30, a maximum peak location is identified or a fast interpolation may be performed to increase the accuracy for determining a sensitivity difference of the microphone under consideration and the reference microphone.

Figure 4:
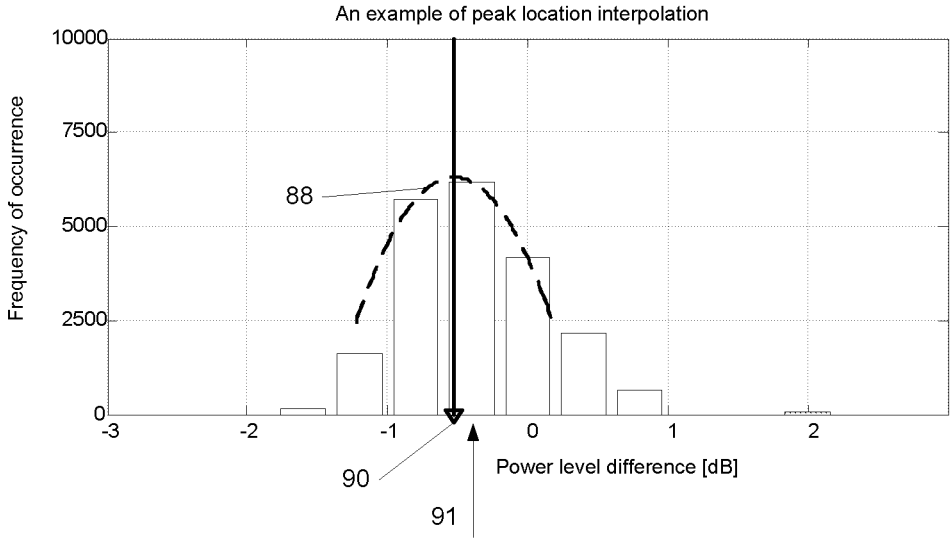
FIG. 4 is a histogram generated according to embodiments of the present invention for two microphones used in a mobile phone showing the a peak location with a parabola using Lagrange interpolation from the power level difference distribution, according to embodiments of the present invention.

Since the sensitivity difference histogram has a limited resolution, the accuracy of the estimation may be improved if the values between bins are also taken into account. According to one embodiment, the sensitivity difference estimation may be derived from the distribution utilizing Lagrange interpolation. A parabola may be fitted to the points defined by the highest bin and the bins adjacent to it, and the peak of the parabola thus can be determined. The sensitivity difference estimate then may be located at the peak position at the corresponding axis. The peak estimation is illustrated in FIG. 4. FIG. 4 shows an example among others of a histogram generated according to embodiments of the present invention for two microphones used in a mobile phone (the same conditions as for FIG. 3*a*) showing the peak location at a point 90 determined by the parabola 88 using Lagrange interpolation from the power level difference distribution, according to the embodiment of the present invention. Also, as described herein, the value of the sensitivity difference can be taken directly using raw histogram maximum value from the histogram peak value as indicated by an arrow 91 in FIG. 4. This will provide a low accuracy estimate (see FIG. 5*a*) of the sensitivity difference (calibration value), but may be enough for certain applications.

In a next step 32 of FIG. 1, it is ascertained whether more accuracy is required for determining the sensitivity differences (e.g., this can be a system design parameter). If that is not the case, in a next step 36 the calculated sensitivity difference may be provided to the gain control module and the process can go to step 38. However, if it is ascertained in step 32 that more accuracy is required, in a next step 34, the sensitivity difference (calibration value) estimate may be updated (refined) using one or more smoothing steps (e.g., using IIR smoothing) and then the updated calibration value may be provided to the gain control module.

Figure 5A:
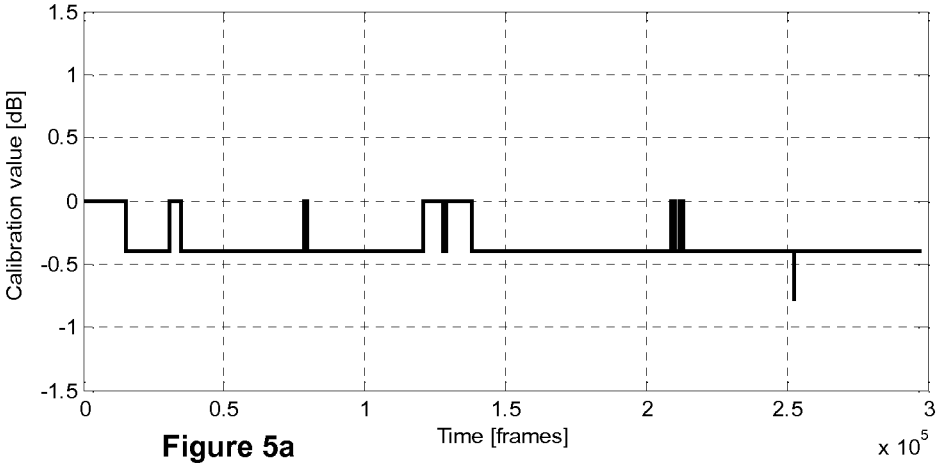
FIGS. 5*a*-5*c* are graphs illustrating calibration values (sensitivity differences) determined by different methods as a function of time: a) using a raw histogram maximum value from the histogram peak value, b) using an interpolation parabola value shown in FIG. 4, and c) using a first fast smoothing and a second slow smoothing, according to embodiments of the present invention.
Figure 5B:
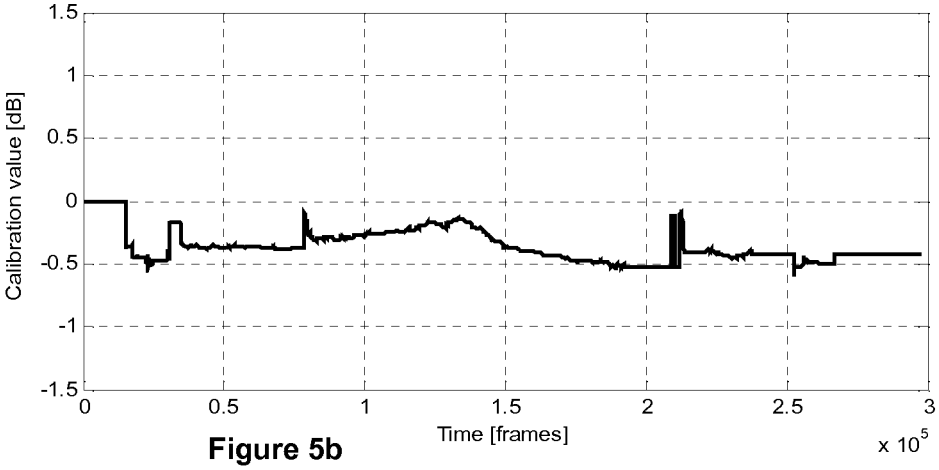
Figure 5C:
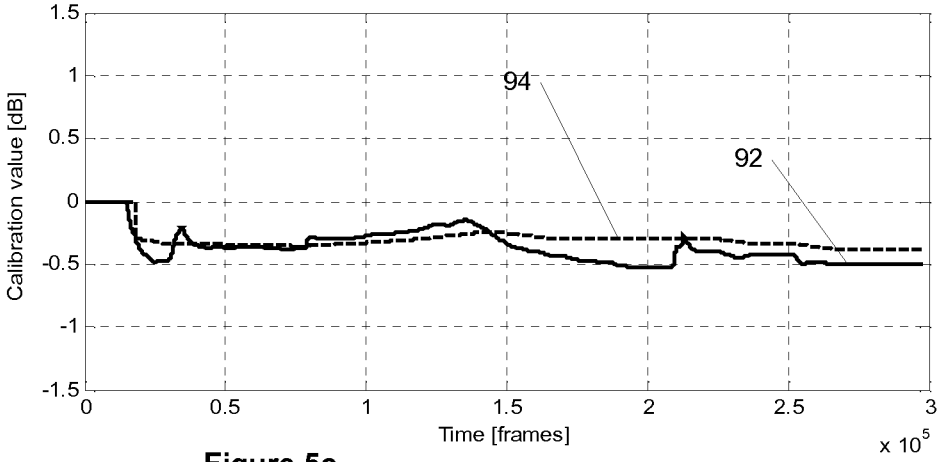

For example, a more stable estimate may be derived using a first fast IIR smoothing (see FIG. 5*c*, curve 92). Since the smoothed estimate may still be quite fluctuating, a second IIR-smoothing may be applied (see FIG. 5*c*, curve 94). The reason for using two separate smoothing stages may be that the faster first one can offer a quicker estimate and the slower one can offer a stable and more precise estimate that can be used in a long run (e.g., saved in memory for future use). All estimates described herein may be also equipped with a maturity check, which can indicate if the estimate is ready to be used.

FIGS. 5*a*-5*c* show examples of graphs illustrating calibration values (sensitivity differences) determined by different methods as a function of time: a) using a raw histogram maximum value from the histogram peak value as indicated by the arrow 91 in FIG. 4; b) using interpolation parabola value shown in FIG. 4, and c) using a first fast smoothing (solid line 92) and a second slow smoothing (dotted line 94) applied to the data of FIG. 4, according to embodiments of the present invention.

Finally, in a next step 38 in FIG. 1, a gain for adjusting amplifying gain of one of other microphone signals is selected. It is noted that for the purpose of the present invention, the amplifying gain can be one, more than one or less than one. It is further noticed that the gain can be selected to be one, e.g., at the start of the algorithm before the histogram becomes mature. Also previously determined gain values can be used during time periods, e.g., when the histogram or smoothening is not mature or the sharpness is not sharp enough, etc.

It is noted that the order of steps shown in FIG. 1 is not absolutely required, so in principle, the various steps can be performed in different order, in various combinations, or even omitted. For example steps 12, 14, 17 and 18 may be optional and omitted for simplified implementation in certain applications. There are a lot of possible variations of the algorithm shown in FIG. 1.

In reference to the signal classification (step 18 in FIG. 1), it is noted that the implementation disclosed in FIG. 1 may be utilized with a beamformer-based ambient noise suppression algorithm using two microphones. The noise suppression algorithm may be designed for speech enhancement, which can improve the speech quality in a speech call. Hence, the signal classification can be used to distinguish between speech and background noise periods. The classification may be also something else, e.g., desired signal vs. noise or generally just "unsuitable for sensitivity detection" vs. "suitable for sensitivity detection". The signal classification may be done either based on one microphone signal or by utilizing signals from more than one microphone. Note, that the algorithm described herein may be used with any calibration-suitable signals, including noise, speech, music, etc., depending on measurement conditions As described herein, the histogram sharpness detection may be implemented using the ratio of the highest bin and sum of all bins. Alternatively, the ratio of the sum of the highest bin and two or more adjacent bins and the sum of all bins may be also used. The optimal amount of bins in the numerator may depend on the used level resolution of the histogram. For example in examples shown in FIGS. 3*a*, 3*b*, and 4, the resolution of 0.4-dB was used with one bin in the numerator. If a finer resolution is needed, more bins may be used in the numerator of the ratio.

In reference to the histogram peak location estimation, an accurate search of the peak location of the histogram may be carried out using more than just three bins of the histogram as used in the examples of FIG. 4 to interpolate the shape of the parabola. The optimal amount of bins may depend on the used level resolution of the histogram.

It is further noted that the simplest implementation form of the algorithm is for matching two microphones (N=2). However, this algorithm may handle more than two microphones, as described herein, wherein one arbitrary microphone is selected to be the reference microphone against which all other microphones are compared. In other words, the power level differences may be calculated between the signal of the reference microphone and the signals of the other microphones. The implementation principles remain the same, and N−1 histograms are needed instead of one histogram (N is the total number of microphones to be matched).

According to a further embodiment of the present invention, further improvement in the calibration robustness (accuracy) can be achieved by using several reference microphones. A complete such solution is that each microphone is compared to all other N−1 microphones. The solution can offer coincident decision paths to define the sensitivity difference between two microphones. In an ideal case all paths should indicate the same sensitivity difference. If this is not the case, it could be decided whether to use the values by averaging them in some suitable manner or to disable the update of the sensitivity difference estimate. A reduced version of the complete solution could be to use more than one but less than N microphones as reference microphones (N being the total number of microphones to be matched).

Furthermore, since it is unlikely that all N microphones (e.g., of the microphone array) become matched simultaneously, the control logic may be designed to indicate the maturity state of the calibration of each microphone. This may allow to start utilizing the microphones one by one for the further processing, e.g., beamforming.

The advantage of the algorithm disclosed herein is that it may not require any separate calibration routines to be done, since the calibration can be carried out on the fly during the normal operation of the electronic device utilizing it. This fact can minimize possible errors in manual calibration, and even more importantly, it can minimize the cost of calibration. Furthermore, microphone component aging and environmental effects on microphone component sensitivities may be handled inherently by the algorithm. Finally, the algorithm does not need information about the microphone positions and the direction of arrival of the desired sound (acoustic signal).

Figure 2:
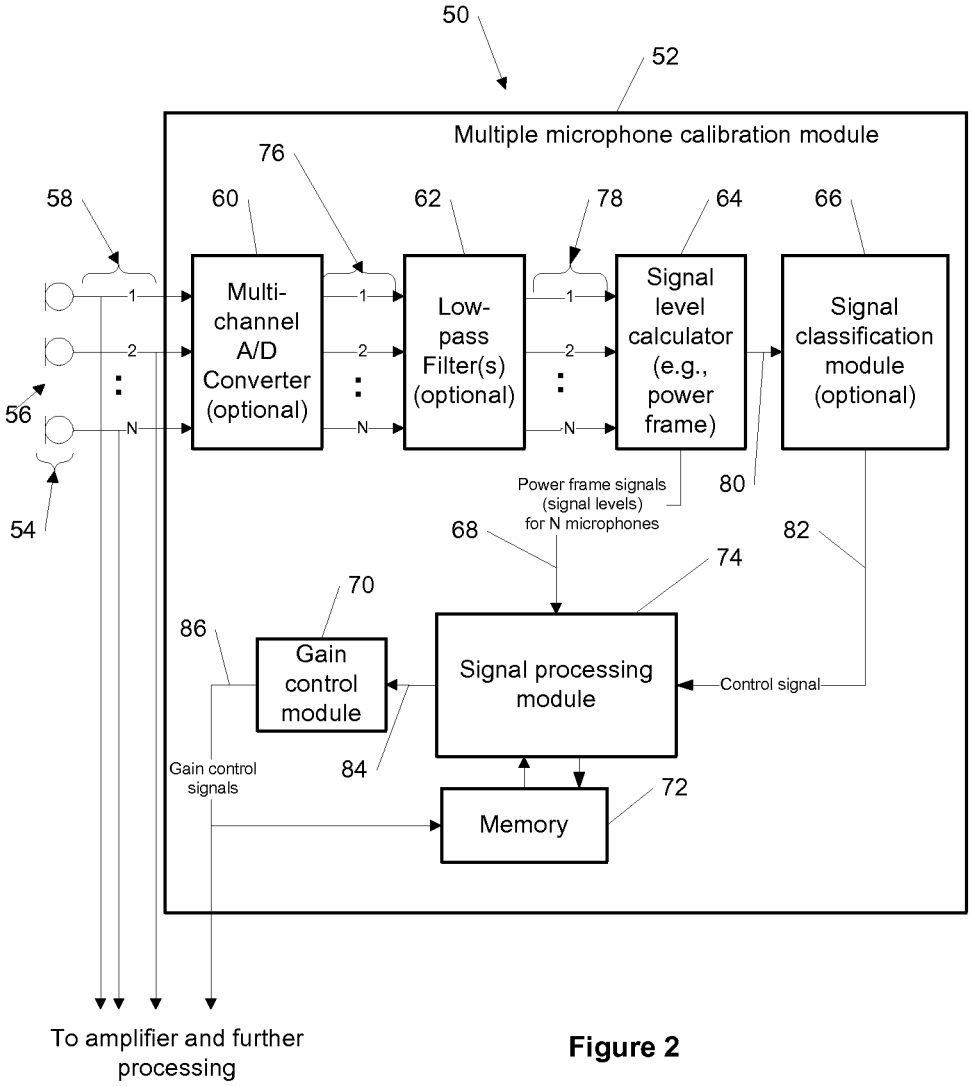
FIG. 2 is a block diagram of en electronic device comprising a multiple microphones calibration module, according to an embodiment of the present invention.

FIG. 2 shows an example among others of a block diagram of en electronic (acoustic) device 50 (e.g., a telephone receiver, a camera phone, a mobile phone, etc.) comprising multiple microphone (e.g., a microphone array) 54 and a multiple microphones calibration module 52, according to an embodiment of the present invention. The module 54 can be a part of the electronic device 50 or it can be a detachable module.

An acoustic signal 56 can be received by a microphone array 54 with N microphones for generating N corresponding microphone signals 58, wherein N is a finite integer of at least a value of two. A multi-channel analog-to-digital (A/D) converter 60 (which can be a part of the module 52, or alternatively be a part of the electronic device 50) can provide A/D conversion of the microphone signals 58 into digital signals 76 (the example shown in FIG. 2 is for digital implementation of the calibration algorithm, but analog implementation can be used as well). The signal processing by the multiple microphones calibration module 52 may be used for implementing steps described in reference to the flow chart of FIG. 1.

The low-pass filter(s) 62 may be optionally used to cut-off high frequency components as described in reference to step 14 of FIG. 1. Then a signal level calculator 64 may compute signal levels for filtered microphone signals 78 (e.g., power frame signals) per step 16 of FIG. 1 for providing power frame signals for N microphones to a signal processing module 74 (alternatively module 64 can be a part of the module 74). A signal classification module (e.g., a voice activity detector) 66 may be optionally used for providing a signal classification for a microphone signal from one reference microphone (in general it could be a plurality of reference microphones as disclosed herein) out of N microphones for controlling the calibration status by providing a control signal 82 to the signal processing module 74. For example, if one component (e.g., noise) is identified, this will indicate that the calibration is suitable, whereas if another component (e.g., speech) is identified, this will indicate that calibration is not suitable (see steps 17 and 18 in FIG. 1). The module 66 can be apart of the module 52 or it can a part of the electronic device 50.

The module 74 maybe used to implement steps 19 through 36 described in reference to FIG. 1 and can provide a signal 84 comprising sensitivity differences (calibration values) for one or more calibrated microphones to a gain control module 70. The gain control module 70 then may select and provide a gain control signals 86 for adjusting one or more amplifying gains for one or more microphone signals which corresponds to the step 38 of FIG. 1 (in general, the amplifying gain can be one, more than one or less than one). In addition, the gain control parameters may be stored in a memory 72 (e.g., a non-volatile memory), for example, for using the stored calibration parameters after interruption in a calibration service. It is also noted that the module 70 may a part of the module 74.

According to an embodiment of the present invention, the modules 74, 64, 62, 66 or 70 may be implemented as a software or a hardware module or a combination thereof. Furthermore, the module 74, 64, 62, 66 or 70 may be implemented as a separate module or may be combined with any other module of the electronic device 50 or it can be split into several modules according to their functionality. Furthermore, an integrated circuit may comprise selected or all modules of the multiple microphones calibration module 52.

As explained above, the invention provides both a method and corresponding equipment consisting of various modules providing the functionality for performing the steps of the method. The modules may be implemented as hardware, or may be implemented as software or firmware for execution by a computer processor. In particular, in the case of firmware or software, the invention can be provided as a computer program product including a computer readable storage structure embodying computer program code (i.e., the software or firmware) thereon for execution by the computer processor.

It is further noted that various embodiments of the present invention recited herein can be used separately, combined or selectively combined for specific applications.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. An apparatus, comprising:

a signal processing module, configured to calculate one or more differences between one or more signal levels from one or more microphones of a plurality of microphones and further one or more signal levels from one or more selected microphones of said plurality of the microphones, configured to create or update one or more difference histograms corresponding to said one or more of selected microphones using said one or more differences, and further configured to determine a sharpness and a sensitivity difference for each of the one or more difference histograms; and a gain control module, configured to adjust one or more amplifying gains for one or more microphone signals corresponding to said one or more microphones using said sensitivity difference for each of the one or more difference histograms corresponding to one of said one or more microphones, if said sharpness meets a predetermined criterion, for matching sensitivities of said plurality of microphones.

2. The apparatus according to claim 1, wherein said signal processing module is configured to update one of the difference histograms corresponding to one of said one or more of the selected microphones if a corresponding difference for said one of said one or more of the selected microphones is within a predetermined range.

3. The apparatus according to claim 1, wherein said signal processing module is configured to determine said sharpness of said each of the difference histograms only if said each of the one or more difference histograms is matured.

4. The apparatus according to claim 1, wherein, if said sharpness meets a predetermined criterion for one of said one or more microphones, said signal processing module is configured to determine said sensitivity difference by identifying a maximum peak location on said each of the one or more difference histograms or using an interpolation.

5. The apparatus according to claim 4, wherein said signal processing module is configured to provide said sensitivity difference to said gain control module to adjust said one or more amplifying gains.

6. The apparatus according to claim 4, wherein said signal processing module is configured to update said sensitivity difference using one or more smoothing methods and to provide said sensitivity difference, after being updated using said one or more smoothing methods, to said gain control module to adjust said one or more amplifying gains.

7. The apparatus according to claim 1, wherein said apparatus further comprises:

a low-pass filter or a plurality of low-pass filters configured to eliminate high frequency components from signals with said one or more signal levels and with said further one or more signal levels.

8. The apparatus according to claim 1, wherein said apparatus further comprises:

a signal level calculator, configured to compute said one or more signal levels and said further one or more signal levels for providing to said signal processing module.

9. The apparatus according to claim 1, wherein said apparatus further comprises:

a signal classification module, configured to separate a signal from each of said one or microphones into a speech and noise components, and further configured to provide one or more control signals comprising calibration-suitable information to said signal processing module.

10. The apparatus according to claim 1, wherein said apparatus further comprises:

an analog-to-digital converter, configured to convert analog microphone signals of said plurality of the microphones into digital microphone signals before determining said one or more signal levels and said further one or more signal levels.

11. The apparatus according to claim 1, wherein said apparatus further comprises:

a memory, configured to store said one or more amplifying gains provided by said gain control module.

12. The apparatus according to claim 1, wherein said apparatus is configured to provide said sensitivity difference for said each of the one or more difference histograms and to adjust said one or more amplifying gains independently of locations of said plurality of the microphones.

13. The apparatus according to claim 1, wherein said one or more signal levels and said further one or more signal levels are power signal levels calculated for a predetermined frame length.

14. A method, comprising:

calculating one or more differences between one or more signal levels from one or more microphones of a plurality of microphones and further one or more signal levels from one or more selected microphones of said plurality of the microphones;

creating or updating one or more difference histograms corresponding to said one or more of selected microphones using said one or more differences, and determining a sharpness and a sensitivity difference for each of the one or more difference histograms; and adjusting one or more amplifying gains for one or more microphone signals corresponding to said one or more microphones using said sensitivity difference for each of the one or more difference histograms corresponding to one of said one or more microphones, if said sharpness meets a predetermined criterion, for matching sensitivities of said plurality of microphones.

15. The method of claim 14, wherein said one or more signal levels and said further one or more signal levels are power signal levels calculated for a predetermined frame length.

16. The method of claim 14, wherein said updating of one of the difference histograms corresponding to one of said one or more of the selected microphones is performed if a corresponding difference for said one of said one or more of the selected microphones is within a predetermined range.

17. The method of claim 14, wherein said determining said sharpness of said each of the difference histograms is performed only if said each of the one or more difference histograms is matured.

18. The method of claim 14, wherein, if said sharpness meets a predetermined criterion for one of said one or more microphones, said determining of said sensitivity difference is performed by identifying a maximum peak location on said each of the one or more difference histograms or using an interpolation.

19. The method of claim 14, wherein, prior to said calculating said differences, the method comprises at least one of:

filtering high frequency components from signals with said one or more signal levels and with said further one or more signal levels, computing said one or more signal level and said further one or more signal levels for providing to said gain control module and separating a signal from each of said one or microphones into a speech and noise components, and providing one or more control signals comprising calibration-suitable information.

20. An electronic device, comprising:

a plurality of microphones; and a multiple microphone calibration module, comprising:

a signal processing module, configured to calculate one or more differences between one or more signal levels from one or more microphones of a plurality of microphones and further one or more signal levels from one or more selected microphones of said plurality of the microphones, configured to create or update one or more difference histograms corresponding to said one or more of selected microphones using said one or more differences, and further configured to determine a sharpness and a sensitivity difference for each of the one or more difference histograms; and a gain control module, configured to adjust one or more amplifying gains for one or more microphone signals corresponding to said one or more microphones using said sensitivity difference for each of the one or more difference histograms corresponding to one of said one or more microphones, if said sharpness meets a predetermined criterion, for matching sensitivities of said plurality of microphones.

* * * * *